United States Patent [19]

Tengler et al.

[11] Patent Number: 4,964,814

[45] Date of Patent: Oct. 23, 1990

[54] SHIELDED AND GROUNDED CONNECTOR SYSTEM FOR COAXIAL CABLES

[75] Inventors: John N. Tengler, Chico, Calif.; Alan L. Roath; John T. Venaleck, both of Madison, Ohio

[73] Assignee: Minnesota Mining and Manufacturing Co., St. Paul, Minn.

[21] Appl. No.: 343,113

[22] Filed: Apr. 24, 1989

Related U.S. Application Data

[63] Continuation of Ser. No. 946,193, Dec. 23, 1986, abandoned, which is a continuation-in-part of Ser. No. 914,803, Oct. 3, 1986, Pat. No. 4,897,046.

[51] Int. Cl.[5] ..... H01R 13/652

[52] U.S. Cl. ..... 439/607; 439/581

[58] Field of Search ..... 439/92, 94, 63, 578, 439/581, 607, 771

[56] References Cited

U.S. PATENT DOCUMENTS

| | | | |
|---|---|---|---|
| 3,109,997 | 11/1963 | Giger et al. . | |
| 3,179,912 | 4/1965 | Huber et al. . | |
| 3,288,957 | 11/1966 | Fraley . | |
| 3,310,772 | 3/1967 | Kirk et al. . | |
| 3,335,388 | 8/1967 | Karol . | |
| 3,408,610 | 10/1968 | Clarkson . | |
| 3,416,125 | 12/1968 | Theve . | |
| 3,548,365 | 12/1970 | 439 | 581/ |
| 3,587,028 | 6/1971 | Uberbacher . | |
| 3,781,763 | 12/1973 | Feeser et al. . | |
| 3,825,874 | 7/1974 | Peverill . | |
| 3,848,164 | 11/1974 | Otte . | |
| 4,088,385 | 5/1978 | Adkins . | |
| 4,231,629 | 11/1980 | Kirby . | |
| 4,340,265 | 7/1982 | Ott et al. . | |
| 4,397,516 | 8/1983 | Koren et al. . | |
| 4,451,107 | 5/1984 | Dola et al. . | |
| 4,453,796 | 6/1984 | Monroe . | |
| 4,466,685 | 8/1984 | Tronchon . | |
| 4,484,792 | 11/1984 | Tengler et al. | 439/578 |
| 4,519,665 | 5/1985 | Althouse et al. . | |
| 4,527,851 | 7/1985 | Gallusser et al. | 439/271 |
| 4,553,806 | 11/1985 | Forney, Jr. et al. . | |
| 4,556,275 | 12/1985 | Hamsher . | |
| 4,572,605 | 2/1986 | Hess . | |
| 4,586,776 | 5/1986 | Ollis et al. . | |
| 4,602,831 | 7/1986 | Lockard . | |
| 4,603,926 | 8/1986 | Nesbitt et al. . | |

FOREIGN PATENT DOCUMENTS

| | | |
|---|---|---|
| 74205 | 3/1983 | European Pat. Off. . |
| 0122700 | 10/1984 | European Pat. Off. . |
| 131248 | 1/1985 | European Pat. Off. . |

OTHER PUBLICATIONS

George Hansell and Herb VanDeusen, "Interconnecting with Subminiature Digital Coax" 1981.

IBM Technical Disclosure Bulletin, vol. 9, No. 10, p. 1312 (3/1967).

Evans et al. IBM Technical Disclosure Bulletin Entitled "Terminal for Coaxial Cable", vol. 9, No. 9, p. 252 (8/66).

*Primary Examiner*—Eugene F. Desmond

*Attorney, Agent, or Firm*—Renner, Otto, Boisselle & Sklar

[57] ABSTRACT

A coaxial cable termination system, includes a coaxial cable terminator including a coaxial cable having signal and shield conductors and insulation separating the conductors, an electrical contact electrically connected to the signal conductor, the electrical contact having a contacting portion for electrically connecting with an external member inserted to engagement with respect thereto, and a strain relief body molded directly to at least part of the coaxial cable and electrical contact for holding the same in relatively fixed positions with respect to each other; a housing having an opening for receiving therein at one end the terminator to hold the same in position to make electrical connection with an external member inserted into the housing means to engage the electrical contact; and an insulator inserted into the opening from the opposite end to insulate the contact from the housing wall bounding the opening. Novel tube-like insulators and bow type contacts also are included.

48 Claims, 6 Drawing Sheets

110
102
104
100
103
106
105

110
102
9
30
24
14
35
20
130
136
116
37
114
112
39
120
124
12
122
105
170
170
126
124
103
118
210
128
14
212
103
30
24
35
37
39
105

103
128
105
37
128
103
35
7S
126
7G

105

SHIELDED AND GROUNDED CONNECTOR SYSTEM FOR COAXIAL CABLES

This application is a continuation of U.S. application Ser. No. 06/946,193 filed Dec. 23, 1986, now abandoned which is a continuation-in-part of U.S. application No. 06/914,803 filed Oct. 3, 1986 now U.S. Pat. No. 4,897,046; the entire disclosure of U.S. application Ser. No. 06/914,803 is hereby incorporated herein by reference.

TECHNICAL FIELD

The present invention relates generally, as is indicated, to improvements in connector systems for coaxial cables and, more particularly, to shielded connector systems and to terminators for use therein. Additionally, the invention relates to terminators for miniature coaxial cables and to systems for terminating miniature coaxial cables.

BACKGROUND

For high speed signal transmission purposes and possibly for other purposes it is often the case that coaxial cables are used. The advantages of coaxial cables are, of course, well known and include, for example, the ability to provide shielding functions to prevent escape of electromagnetic energy and/or undesirable input of electromagnetic energy with respect to signal conductors. Another example has to do with impedance characteristics that improve accuracy and/or efficiency, e.g. speed, of signal transmission and of transmitted signal characteristics.

An exemplary coaxial cable typically includes a signal conductor, a shield or ground conductor and appropriate insulation. Sometimes a drain wire is used, for example, to improve the integrity of the shield conductor. Ordinarily the signal conductor is located at the radial center of the coaxial cable and insulation separates the signal conductor from the radially outer and usually surrounding shield conductor. The shield conductor may be, for example, a hollow cylinder with a solid wall or a braided material. Various insulation materials are used to separate the signal and shield conductors, as is well known; and it usually is the case that further insulation is used on the outside of the shield conductor as well. Usually the signal conductor is used to conduct an electrical signal that has a particular purpose, information content, etc., and usually the shield conductor is connected to a source of reference electrical potential, such as ground potential relative to the level of the signals typically carried by the signal conductor. The foregoing signal carrying functions and connections, of course, are exemplary only, and it will be appreciated that the conductors of the coaxial cable may be used for other signal carrying/conducting purposes, too.

Various techniques have been used in the past to terminate a coaxial cable. The present invention provides improvements for terminating coaxial cable and for connecting the cable to other conductors while minimizing signal degradation and while substantially maintaining in the terminator electrical characteristics similar to those in the coaxial cable.

BRIEF SUMMARY OF THE INVENTION

Briefly, the fundamental components of the present invention include a coaxial cable termination system, comprising a coaxial cable terminator including a coaxial cable having signal and shield conductors and insulation separating said conductors, an electrical contact electrically connected to the signal conductor, the electrical contact having a contacting portion for electrically connecting with an external member inserted to engagement with respect thereto, a protective insulator means for covering at least part of the contacting portion, and a strain relief body molded directly to at least part of the coaxial cable, electrical contact and a protective insulator for holding the same in relatively fixed positions with respect to each other; and a housing for receiving therein the terminator to hold the same in position to make electrical connection with an external member inserted into the housing means to engage the electrical contact.

Another aspect of the invention relates to a coaxial cable terminator, comprising a coaxial cable having signal and shield conductors and insulation separating the conductors, an electrical contact electrically connected to the signal conductor, the electrical contact having a contacting portion for electrically connecting with an external member inserted to engagement with respect thereto, a protective insulator for covering at least part of the contacting portion, and a strain relief body molded directly to at least part of the coaxial cable, electrical contact and insulator for holding the same in relatively fixed positions with respect to each other.

An additional aspect relates to an insertable insulator arrangement for a coaxial cable termination system generally of the type described, for example, to facilitate manufacturing, and versatility of the system and parts thereof. Such insulator may be inserted into and/or onto the front end of one electrically conductive housing of the system to insulate one or more signal contacts from the housing while also providing convenient access to the ground contact(s) contained in the housing.

A further aspect is to provide a new ground contact for the termination system. Still further aspects relate to new arrangements of signal and ground contacts in a termination system of the type described.

As is described in detail below, the invention helps to maintain impedance characteristics of the cable through the interconnection device (terminator and housing) by the illustrated geometrical relationships, the bringing of the signal contacts and the ground (e.g. provided by the housing) to a near coterminal relation at the front end thereof, the use of the ground contacts and the sharing thereof and relative positioning thereof with respect to the signals carried by the terminators, and so on. The invention also helps minimize cross talk. These and other relationships and interactions may be used in various combinations consistent with the present invention.

These and other objects and aspects of the present invention will become more apparent as the following description proceeds.

To the accomplishment of the foregoing and related ends, the invention, then, comprises the features hereinafter described in the specification and particularly pointed out in the claims, the following description and the annexed drawings providing but one exemplary illustration of a preferred embodiment of the invention. However, it will be appreciated that the invention relates to equivalent parts and functions and is limited only to the extent of the scope of the claims.

DESCRIPTION OF THE PREFERRED EMBODIMENT

Figure 1:
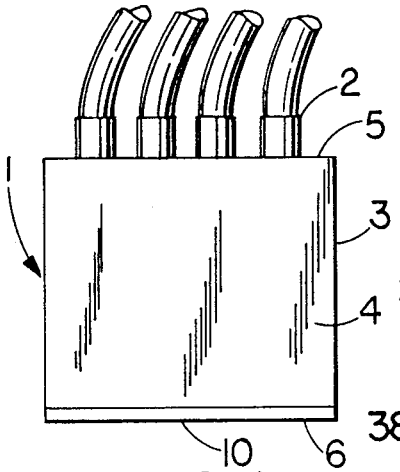
FIG. 1 is an elevation view of a coaxial cable termination system according to the present invention.
Figure 2:
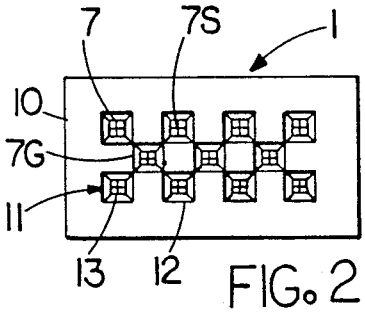
FIG. 2 is a front view of the termination system of FIG. 1.

Referring, now, in detail to the drawings, wherein like reference numerals designate like parts in the several figures, and initially to FIGS. 1 and 2, a coaxial cable termination system in accordance with the present invention is generally designated 1. The termination system 1 includes one or more coaxial cable terminators 2 that are insertable into a housing 3. Each terminator 2 may, for example, be used to carry a signal, such as a high speed electrical signal. The housing 3 may be a zinc or an aluminum block 4 that is cast and has plural openings therethrough to receive respective terminators therein.

Figure 9:
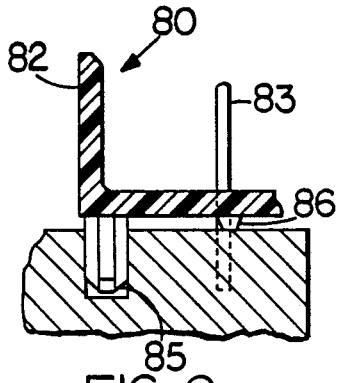
FIG. 9 is an enlarged fragmentary section view of the pinless shroud showing the retaining post thereof for retention in a printed circuit board and showing header pin contacts protruding therein for electrical connection with the electrical contacts of the termination system of the invention.

The housing block 4 provides structural support for the terminators where they connect with other external members, such as electrical pin contacts (shown in FIG. 9). Such support function, and an associate protective function, are important in the present invention in view of the possible substantial miniaturization of the coaxial cable and termination associated therewith to make up the coaxial cable terminator. The housing block also preferably is electrically conductive so that it provides a substantial shielding function as well as a direct engagement electrical connection grounding function along the entire length of the termination portion of the terminator where the insulation of the signal and shield conductors of the coaxial cable and where the electrical contact of the terminator are otherwise exposed, as will become more apparent from the following description.

As is seen in FIGS. 1 and 2, the housing block 4 has a back end 5 into which the terminators 2 are inserted and a front or leading end into which external members, hereinafter referred to as pin contacts or the like, may be inserted for electrical connection with the signal conductor, for example, for respective terminators. It will be appreciated that the external members, though, may be other than pin contacts. Openings 7 (discussed further below) extend through the housing 3 to permit such insertion of the terminators 2 and pin contacts. The housing block 4 may be a rectangular cross section block of electrically conductive metal. Alternatively, although less desirably, the housing block 3 may be of plastic or other material that has an electrically conductive coating on the surface to provide the desired electrical connection and shielding functions.

Figure 3:
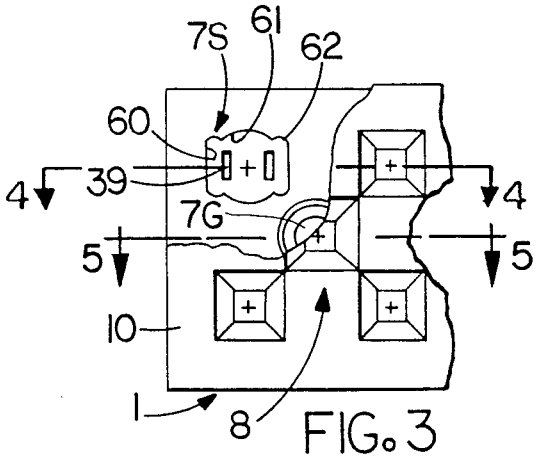
FIG. 3 is an enlarged fragmentary front view of the termination system partly broken away to show an opening in the housing and part of a signal contact.
Figure 5:
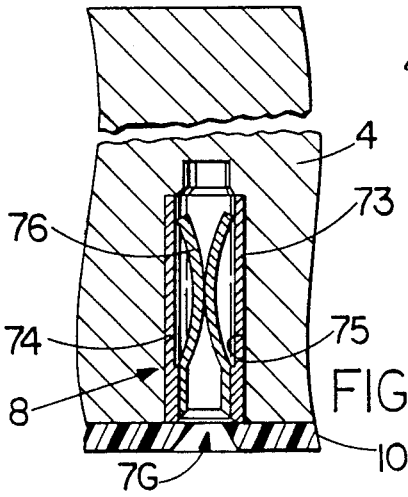
FIG. 5 is an enlarged fragmentary section view of the ground contact arrangement for the termination system looking generally in the direction of the arrows 5—5 of FIG. 3.

The housing 3 also includes one or more ground contact connections 8 (FIGS. 3 and 5). As is described in greater detail below, such ground contact connections 8 bring a ground connection of a printed circuit board or other device from which the mentioned pin contacts derive to close proximity with respective signal carrying coaxial cable terminators 2 without having to rely on the electrical conducting properties of the exterior of housing block 4. Such use of ground connections rather proximate the signal connections provided by the terminators 2 helps to maintain the integrity (e.g. wave shape) and transmission speed of the transmitted electrical signal(s) while also helping to maintain the desired characteristic impedance matched to that of the coaxial cable 9. Accordingly, desirably there is a ground contact connection 8 inclose proximity to each signal carrying terminator 2; and this is possible in the present invention even with plural terminators 2 by using, for example, a shared arrangement of ground contact connections 8, say as is shown in FIGS. 1–3. This provides an efficient high density arrangement of grounds and signals.

Thus, a preferred pattern for the termination system 1, according to the invention, when plural signals and terminators 2 carrying them are used, in the shared configuration illustrated in FIG. 2. Such arrangement places a ground contact connection for effective use with four signal contacts. The ground contact openings in the termination system 1 are designated 7G, and the signal carrying/terminator openings are designated and referred to interchangeably 7 and 7S; and, depending on context, the openings 7S, 7G may be collectively referred to as openings 7. The system 1 illustrated in FIGS. 1 and 2 has eight signal connection positions represented by the openings 7S and also has three ground connection positions. If desired, the termination system 1 may be reduced in size to have as few as two positions, one for ground and one for signal; or the system 1 may be expanded in size, say to provide for thirty, sixty or more or fewer signal positions and corresponding ground positions, e.g. by replicating the pattern arrangement shown in FIGS. 1 and 2.

To help prevent pin contacts and/or other devices from engaging and short circuiting with the housing block 4, a front insulator 10 is provided at the front end 6 of the housing block 4. The front insulator may be an electrically non-conductive plate having plural openings 11 therein positioned to align with respective openings 7 in the housing block. Moreover, such openings 11 preferably have a tapered or sloping front wall 12 or lead in to guide a pin contact into and through the passage 13 of the respective opening 11 into the opening 7 of the housing block 4. Furthermore, such sloping lead in 12 is of a size to guide a pin contact into the opening 7 without touching an interior wall of such opening 7, as is seen more clearly in FIG. 4, for example.

Since the termination system 1 has a regular configuration, e.g. the housing 3 has a rectangular footprint and generally straight side walls, preferably multiple systems 1 may be placed in close proximity to each other to increase the number of connections made between coaxial cables and pin contacts, say arranged in a pin field on a printed circuit boar, in a relatively minimum space while continuing the desired ground, shielding and impedance matching characteristics. The systems 1 may have another configuration that also provides such functions to various respective degrees of density of signal carrying coaxial cable terminators 2. Means (not shown) may be provided for separately mounting and/or securing the housing 3 to a printed circuit board or to another device to hold the termination system 1 in appropriate location for use.

Figure 4:
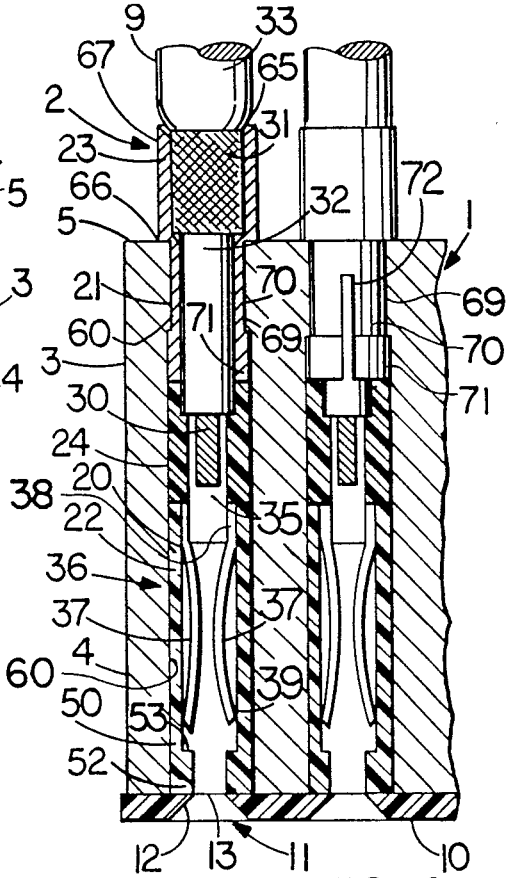
FIG. 4 is an enlarged fragmentary section view of the signal contacts and coaxial cable terminators of the termination system looking generally in the direction of the arrows 4—4 of FIG. 3.

Turning, now, to FIGS. 3 and 4 details of the terminator 2 and the cooperative relation thereof with respect to the housing 3 are shown. The terminator 2 includes the coaxial cable 9, a first electrical contact (the signal contact) 20, a second electrical contact (the shield or ground contact) 21, a protective electrically non-conductive sheath 22 at the leading end of the terminator, an electrically conductive shield terminator 23 at the back end of the terminator and of which the ground contact is a part, and a strain relief body 24 directly molded to at least part of each of the foregoing to form a substantially secure structure therewith.

The coaxial cable 9 includes a signal conductor 30, a ground or shield conductor 31, insulation 32 separating such conductors, and an outer insulation jacket 33. The invention is particularly useful with miniature coaxial cables, and, accordingly, such cable 9 preferably is a miniature one and the terminator 2 is of a cross sectional size enabling use to connect with respective pin contacts in a pin field that has signal/ground spacing on less than 0.100 centers. Such cables 9 themselves are commercially available.

Toward the leading end of the terminator 2 is the signal contact 20. Such signal contact has a flat connecting portion (or other shape portion) 35 for electrical attachment to the exposed end of the signal conductor 30 of the cable 9. Such electrical attachment may be by soldering, welding or the like. The signal contact 20 also includes a contacting portion 36 intended to make an electrical connection with a pin contact or other external member that is inserted to engage the same. As is described herein, the pin contact is inserted to engage the signal contact 20; however, it will be appreciated that the insertion movement may be of the signal contact with respect to the pin contact. What is required is relative movement of the signal contact and pin contact to effect electrical connection thereof.

Looking at FIG. 4, the contacting portion 36 of the signal contact 20 is formed by a pair of bowed arms 37 that are bent or otherwise formed relative to the flat connecting portion 35 so that the width dimension thereof is generally perpendicularly oriented relative to the width dimension of the flat connecting portion. The bowed configuration of the arms 37 is such that a relatively narrow contacting area is located therebetween for interference fit with a pin contact inserted to engage the same. At the back end of the arms 37 they are attached to the flat connecting portion by relatively straight supports 38 of the contact 20, and the leading end 39 of the bowed arms 37 are supported by the protective sheath 22. The bowed contact configuration provides good compliance characteristics for the signal contact 20. The paired arms 37 also may allow for a degree of balancing of forces as and after a pin contact is inserted therebetween to minimize the maximum deformation of each arm 37. Further, in view of the miniature size of the signal contact, e.g. having a length on the order of less than one half inch and a thickness of material less than 0.010 inch, the dual support of each bowed arm 37, i.e. both at the back end supports 38 and at the leading ends 39, desired compliance, miniaturization and operational characteristics can be achieved without damaging the contact 20 as pin contacts are inserted to engage the same.

Figure 6:
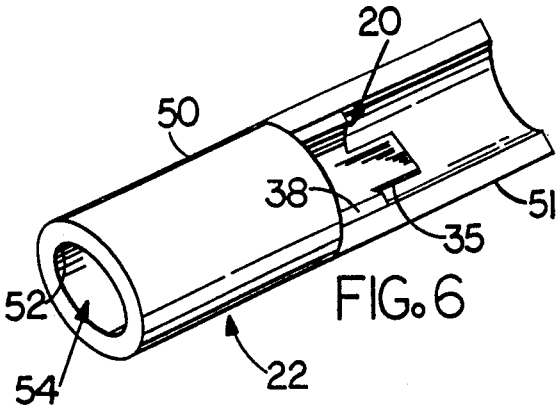
FIG. 6 is an enlarged fragmentary view of the protective insulator and part of the electrical contact of the terminator according to the invention.

As is seen in FIGS. 4 and 6, the protective sheath 22 is in the form of a hollow tubular member 50 with one or more tail portions 51. The hollow tube 50 has an outside dimension to fit relatively snugly (although a smooth sliding fit of various degrees of tightness or looseness may be achieved as a function of relative dimensions) in a signal opening 7S of the housing block 4. At the leading end of the tube 50 is a relatively thick wall 52 the purpose of which is to provide strength and, more importantly, to provide a protective step 53 beneath which the leading end 39 of the bow contact arms 37 are protected from directly engaging an inserted pin contact thereby preventing the possibility of damage to the arms 37, particularly by the insertion of a misaligned pin contact into the opening 7S. The thickness of such wall 52 is approximately the same as the cross sectional dimension of the passage 13 through opening 11 of the front insulator 10 so that the tapered lead in 12 of the opening 11 provides a smooth direct entry into the interior 54 of the protective sheath 22 for guiding a pin contact to engagement with the contacting portion 36 arms 37 of the signal contact 20.

The protective tubular sheath 22 provides a function of electrically insulating the signal contact 20 from the interior wall 60 of the housing 3 opening 7S. Preferably at least part of both the supports 38 and leading ends 39 of the contacting portions 36 or arms 37 of the signal contact 20 engage the surface of the interior wall of the sheath support to provide dual support for the arms 37, i.e. at both the forward and rearward ends thereof, to achieve the above-mentioned compliance, strength and repetitive operational characteristics.

Preferably, too, the impedance characteristics of the protective sheath 22, the amount of material used in the same, the configuration of the signal contact 20, and the spacing of the signal contact, and, particularly the contacting portion 36 thereof, relative to the interior wall 60 of the housing opening 7S are so selected to tend to maintain along the length of the signal contact 20 effectively the same impedance characteristics as the characteristic impedance, say 50 ohms, of the coaxial cable 9. For this purpose, the sizes of the parts of the signal contact 20 and the size, thickness and shape of the protective sheath 22 are, accordingly, selected to have a relationship generally as is depicted in the drawings. Moreover, provision for air space also is made to lump the impedance of such air space with that of the various solid materials of the terminator.

Additionally, as is seen in FIG. 3, the cross section shape of the opening 7S is a multi-curved configuration with several different radii of curvature and straight wall portions. Indeed, such shape is generally oval or elliptical. The narrow axis, e.g. vertical as viewed in FIG. 3, provides spacing for a pin contact relative to the wall area 61 of the opening 7S a distance that tends to maintain the mentioned impedance matching with respect to the characteristic impedance of the cable 9. Moreover, the larger axis, e.g. horizontal as viewed in FIG. 3, provides spacing for such pin contact and the arms 37 of the signal contact 20 relative to the wall area 62 of the opening 7S for the same purpose. The thickness of the wall of the protective sheath 22 preferably is minimized, while still maintaining adequate thickness for desired strength, to provide a relatively maximum air space between the electrically conductive portions of the signal contact and pin contact, on the one hand, and the respective wall areas of the opening 7S of the housing 3.

The tail 51 of the protective sheath 22 extends relatively rearwardly to provide a connection thereof with the molded strain relief 24. Such strain relief 24 may tend to knit such tail 51 to form a secure integral structure therewith. The tail 51 is seen most clearly in FIG. 6 as a single tail that represents a semicircular cross sectional portion of the forward hollow tubular part 50 of the sheath 22. Thus, the sheath 22 may be formed of plastic or like material that is electrically non-conductive and that can be formed by plastic injection molding techniques.

The shield terminator 23 preferably is a hollow metal tube, e.g. of brass, that can slide over the cable 9 to engage the shield conductor 31 of the cable. Such shield conductor 31 may be a braided shield, as is well known, or may be another type of shield. The shield terminator 23 and the shield conductor 31 may be soldered, as at 65, to form a good electrical and mechanical connection thereof. Moreover, the two preferably are positioned in relatively tight fitting relation to each other to form a fore fit connection thereof, e.g. by a distorting force applied to the shield termination as it is inserted into the opening 7S of the housing 3.

The shield terminator 23 is engaged at its leading or forward end (where it forms the ground contact 21 for the terminator 2) with the strain relief 24. The strain relief 24 is molded in place and to the shield terminator after the shield terminator is installed on the cable 9.

Further, the shield terminator 23 has a step 66 between the portion 67 thereof that engages the cable shield conductor 31 and remains portion 67 thereof that engages the cable shield conductor 31 and remains outside the housing 3 and the ground contact portion 21 that extends into the opening 7S of the housing 3. Such step is provided to limit the maximum insertion penetration of the terminator 2 into the opening 7S so that the leading end of the protective sheath 22 will not be damaged by forcing the same against the front insulator 10 and also will not damage the latter. Moreover, such step 67 also provides electrical connection between the back end 5 of the housing 3 and shield terminator 23.

At the back end of the opening 7S in the housing 3 is a reduced cross section detent portion 69; and at an axially central portion of the shield terminator 23 is a relief of reduced thickness area 70 of the tubular body of the terminator 23. Such detent portion 69 and relief 70 are cooperatively interrelated to provide a locking function to interfere with each other thereby to tend to retain the terminator 2 in the opening 7S of the housing 3.

To manufacture the terminator 2, the cable 9 is appropriately stripped, e.g. as is seen in FIG. 4, to expose the various portions of the braid or shield conductor 31, of the insulation 32, and of the signal conductor 30. The shield terminator 23, such as the described brass ferrule or the like, is slid to place and is soldered to the shield conductor 31. Thereafter, the signal contact 20 and signal conductor 30 are soldered or welded together. The protective sheath 22 is slid into place placing at least part of the contacting portion 36 of the signal contact 20 therein and placing the tail 51 thereof in direct engagement with the leading edge of the shield terminator 23. The strain relief body 24 then is directly molded in place in such a way as to form a secure and substantially integral structure with the cable 9, signal contact 20, protective sheath 22, and shield terminator 23, as is illustrated in FIG. 4, for example. The material of which the strain relief 24 is made is that which preferably can be injection molded, e.g. plastic, and preferably has impedance characteristics that help to assure continued substantial matching of the impedance characteristics of the cable 9. An example of such molding material may be a polyolefin.

Preferably the outside configuration of that part of the terminator 2 that is inserted into the opening 7S is generally cylindrical. Moreover, the radius of curvature of such cylindrical terminator is about the same as that of the wall area portions 61 of the opening 7S. Therefore, such wall areas 61 cooperate with the outside surface of the terminator 2 to hold the latter relatively securely and without movement within the opening 7S.

Referring to FIGS. 3 and 5, the ground contact connection 8 includes a ground contact 73, which preferably is a press fit conventional contact that is inserted into the ground opening 7G in the housing block 4. Such contact 73 preferably has a portion 74 that makes good electrical connection with the walls 75 of the opening 7G and also has compliant contacting portions 76 for electrically connecting with a pin contact or the like inserted to engagement with respect thereto. The opening 7G may be stepped, as is shown to accommodate the ground contact 73 and also to provide for full insertion of a pin contact into the same. Preferably the opening 11 of the front insulator 10 aligned with the ground opening 7G and ground contact 73 has the same useful tapered lead in 12 and passage 13 configuration as with the openings 11 aligned with signal openings 7S to guide pin contacts into the ground opening 7G without damaging either the ground contact 73 or the inserted pin contact.

As is seen in FIG. 3, moreover, the cross sectional shape of the ground opening 7G preferably is circular to accommodate the ground contact 73.

The pattern of openings 7S, 7G and of contacts in the housing 3 and overall system 1 is such that a number, e.g. four, of signals can share a common ground; also, relatively maximum spacing of signals is provided while relatively close spacing of the signals to the respective ground is provided.

Figure 7:
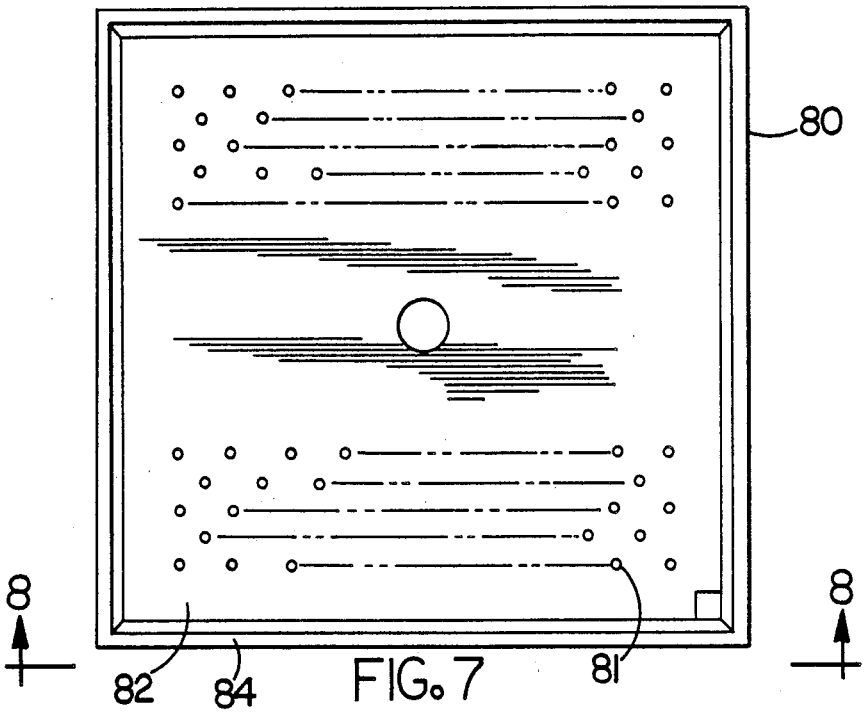
FIG. 7 is an elevation view of a pinless shroud for use with the termination system of the invention.
Figure 8:
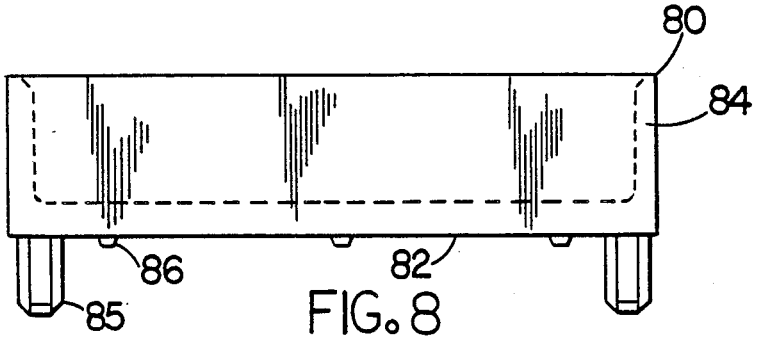
FIG. 8 is a top plan view of the pinless shroud looking generally in the direction of the arrows 8—8 of FIG. 7.

Briefly referring to FIGS. 7, 8 and 9, a pinless shroud 80 is shown. The shroud 80 preferably is formed of electrically non-conductive material that is made by plastic injection molding. The shroud 80 has plural openings 81 (FIG. 7) in the bottom wall 82 thereof to pass therethrough respective pin contacts 83 (FIG. 9) constituting a pin field that is accessible for connection to the termination system 1 of the invention. The pin contacts 83 are not shown in FIG. 7 for simplifying the drawing; the openings 81 through which the pin contacts 83 extend are shown in FIG. 8. The shroud provides support and alignment features for the system 1 and the pin contacts 83. To those ends, the shroud has side walls 84 to guide the housings 3 to proper location therein; a plurality of such housings 3 of small size or one of larger size may be installed within the shroud on respective pin contacts 83.

At the bottom of the shroud 80 are a plurality of retaining posts 85 that may fit into openings on the surface of a printed circuit board to retain the shroud thereon. The shroud may be used, too, to help assure separation of the front end of the system 1 from the surface of the printed circuit board to avoid interfering with circuits printed thereon; additionally, the shroud 80 may have stand offs 86 to help keep the wall 82 thereof also off the surface of the printed circuit board.

One by One Coaxial Cable Termination System (FIGS. 10–26)

Figures 10, 11, 12, 13, 14, 15:
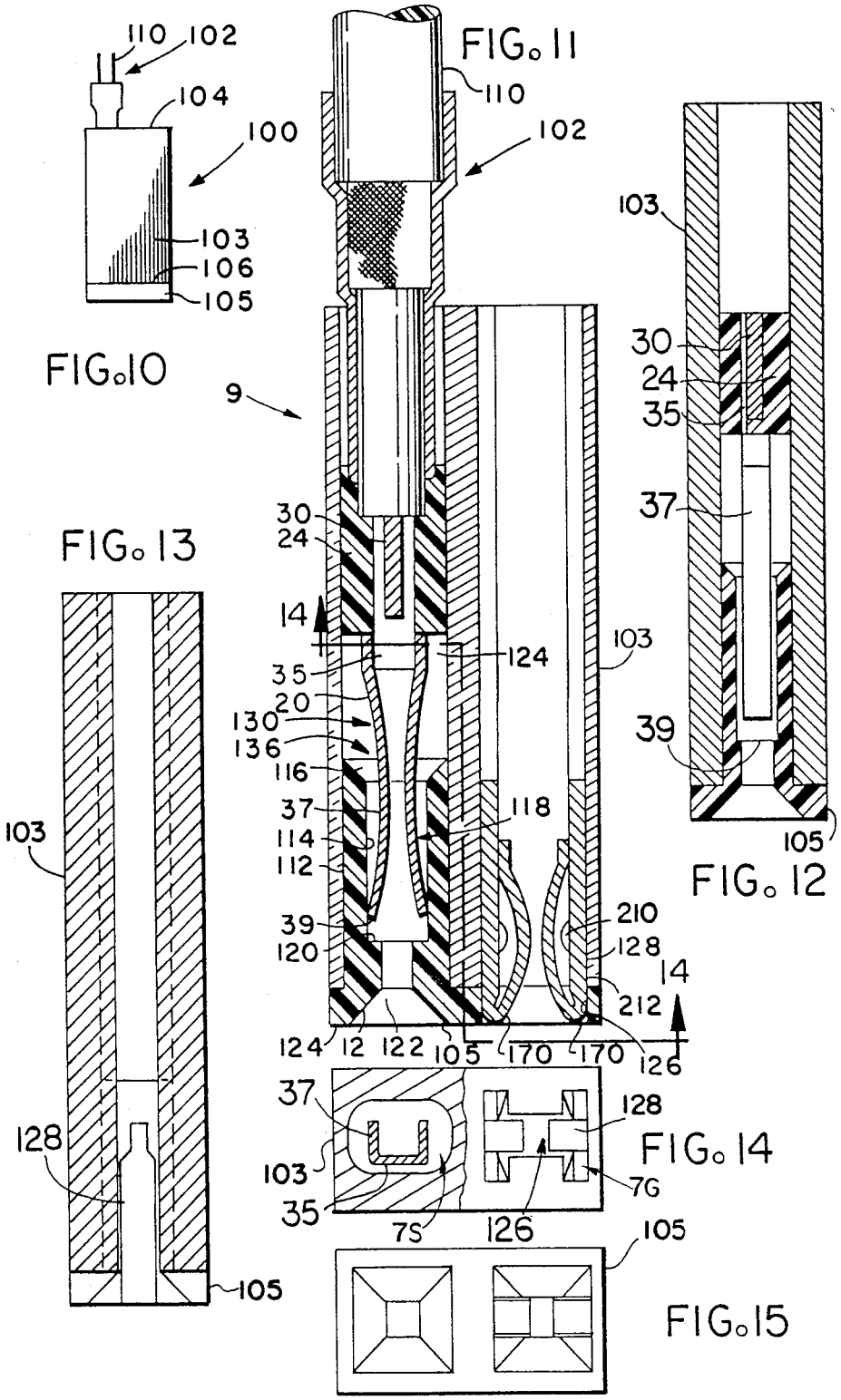
FIG. 10 is a side elevation view of a one by one coaxial cable termination system in accordance with an alternate version of the present invention.
FIG. 11 is an enlarged side elevation view, mostly in section, of the one by one system of FIG. 10.
FIGS. 12 and 13 are, respectively, left and right end elevation views, mostly in section, of the one by one system of FIG. 11.
FIG. 14 is a front section view of the one by one system of FIG. 11 looking generally in the direction of the arrows 14—14, the insulator at the ground contact of such system not being shown in FIG. 14.
FIG. 15 is a front end view of the one by one system of FIGS. 10–14.
Figure 18:
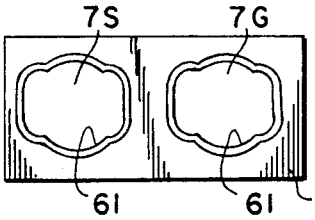
FIGS. 16–19 are, respectively, side elevation, end elevation, back and front views of the electrically conductive housing of the one by one system of FIG. 10.
Figure 16:
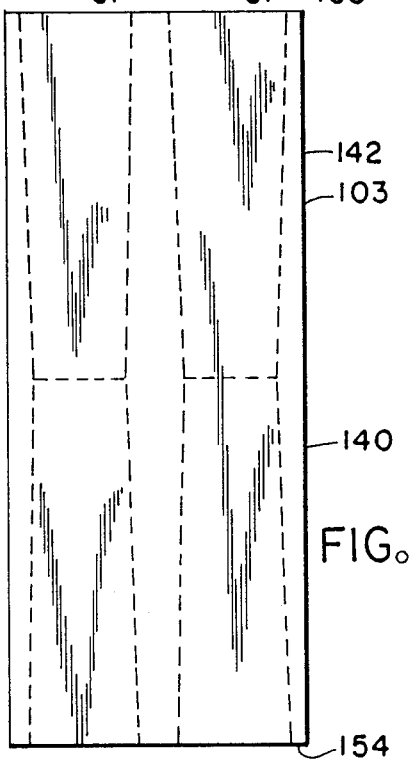
Figure 17:
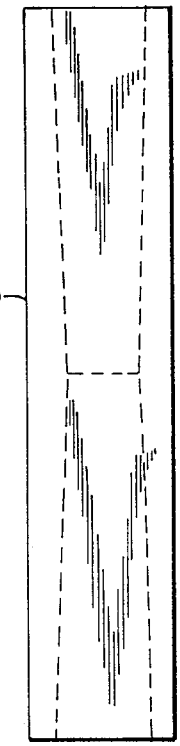

An alternate embodiment of the present invention in the form of a one by one coaxial cable termination system is shown at 100 in FIG. 10. Such system 100 includes a coaxial cable terminator 102, an electrically conductive housing 103, into the back end 104 of which the terminator 102 is inserted, and an insulator 105, which is inserted into and/or with respect to the front end 106 of the housing 103. The one by one system 100 is provided for the purpose of coupling the signal conductor of a coaxial cable 110 with another external electrically conductive member, such as one of the pins 83 (FIG. 9), while maintaining good shielding and grounding functions using the housing 103, a ground contact (not shown in FIG. 10) in the housing and simultaneously connected to another pin 83, for example, as is described above with respect to the system 1 of FIG. 1. The details of the one by one system are described further below. However, it will be appreciated that although such details are described with reference to a system that includes a single signal conductor and a single ground connection (thus the one [signal] by one [ground] label for the system 100), principles and features of the invention described with respect to such one by one system are applicable to coaxial cable termination systems that are of a larger size, say having more than one signal conductor and contact connection and/or more than one ground contact connection. Also, although the preferred embodiment includes a discrete single signal conductor coaxial cable 102, principles of the invention may be extended to coaxial cables with more than two conductors and to ribbon coaxial cables.

The terminator 102 is substantially the same as the terminator 2 described in detail above except that there is no protective electrically nonconductive sheath 22. Rather, the strain relief 24 is molded directly to the signal contact 20 at the flat connecting portion 35 thereof, for example using plastic injection molding techniques. The signal conductor 30 is attached to the contact connecting portion 35, for example by spot welding or other technique, and since the protective sheath 22 is not employed in this embodiment, the contacting portion 36 of the signal contact is relatively free and exposed beyond or in front of the strain relief 24, as is seen most clearly in FIGS. 11 and 12. The arms 37 of the contact 20 are relatively fragile, as was mentioned above, and, therefore, it is desirable that they be dual-supported for strength, to avoid overstressing the same beyond elastic limit, to provide adequate normal force against a pin contact inserted to engagement therewith, and to help assure adequate compliance characteristics. In one example, the signal contact 20 may be formed of strip stock having a thickness at the arms 37 on the order of about 0.006 inch.

Providing support for the leading ends 39 of the contact arms 36 and also insulating the contact arms from the walls of the housing 103 is the insulator 105. More specifically, the insulator 105 includes a hollow tubular portion 112, which has an inner wall 114 which provides the desired support and insulation functions mentioned and defines a volume in which the contacting portion 36 is contained. Therefore, as a pin 83, for example, is inserted to the contacting portion and the latter resiliently deforms, it will not engage the housing 103 in the opening 7S.

The insulator 105 can be installed by inserting the tubular portion 112 thereof into the opening 7S of the housing 103 either before or after the terminator 102 has been installed. At the back end of the insulator 105 is a relatively wide opening 116 to pass the forward portions of the contact arms 37 into the hollow area 118 within the tubular portion 112. The leading ends 39 of the contact arms 37 preferably are supported against the wall 114 of the insulator tubular portion 112 especially as the arms are deformed by a pin contact 83 inserted to engage the same. A step 120 protects the leading ends 39 of the contact arms, which ordinarily are recessed below the step so that when a pin contact is inserted through the entrance 122 of the insulator 105 to engage the signal contact 20, such leading ends 39 are protected and will not be confronted head on by the inserted pin contact. The contacts may be formed of beryllium copper and may in fact be goldplated.

At the front or leading end 124 of the insulator 105, the entrance 122 is in the form of a tapered or sloping lead-in opening having a sloping front wall 12 for guiding a pin contact through the entrance 122 into engagement with a signal contact 20. Also in the front end 124 is a slot-like opening 126 provided to provide exposure of the ground contact 128 described further below. A particular advantage to the use of the tubular insulator 105 to provide insulating and support functions for the signal contact 20 is that the axial length of the tubular portion 112 may be relatively short so that a relatively large air space 130 is provided within the opening 7S between the strain relief 24 and the back end of the tubular portion 112 of the insulator 105. Such air space facilitates impedance matching and avoids unnecessary possible restriction or interference with the contact arms 37.

The molded strain relief 24 helps to hold the signal contact 20 in proper position relative to the major extent of the terminator 102 so that as the terminator 102 is inserted into the housing 103, the contact arms 37 will be guided properly into the tubular portion 112 of the insulator 105. Accordingly, the strain relief preferably has a circular cross section substantially the same as that of the ferrule 23 described above. The circular cross section of the strain relief 24, then, cooperates with the wall 61 of the signal opening 7S in the housing 103 for such angular and on-axis positioning of the terminator and, more particularly, the contact arms 37, as was mentioned.

The housing 103 itself preferably is formed of electrically conductive material, such as a zinc alloy. Such material may be tin plated, may be coated with an electrical nonconductor, or in fact may itself be an electrical nonconductor, although in the latter case the desired shielding function would not be accomplished unless such nonconductor also included a conductive material associated therewith. An example might be the types of materials used in housings for computers and the like, which materials are conductive plastics or similar materials.

Preferably the housing 103 is made by a die casting process. The forward half 140 of the housing 103 has signal and ground openings 7S', 7G' of one shape, illustrated in FIG. 19, for example, and the back half 142 of the housing 103 has signal and ground openings 7S, 7G of a second shape. The two pairs of different shape openings are made simultaneously by core pins used during the die casting process, as is well known. The wall area 61 of the openings 7S, 7G at the back end and the wall portion 61' at the front end are essentially the same and of the same radius of curvature; however, the wall portions 62' at the front end 140 are different from the wall portions 62 at the back end so as to define a generally rectangular space into which part of ground contact 128 may be inserted as will be described further below. The openings through the housing 103 may be slightly tapered in the manner illustrated in FIGS. 16–19 to facilitate insertion and/or removal of various parts with respect thereto and to facilitate manufacturing, particularly the withdrawal of core pins after the die casting process.

The shape of the openings 7S, 7G provides the above-mentioned desirable spacing of contacts to help maintain spatial relation of signal and ground contacts 20, 128. The lobe-like shape of the openings 7S, 7G cooperates with the cylindrical exterior wall of the molded strain relief 24 and the ferrule 23 to help assure proper angular orientation of the terminator 102 as it is inserted into the opening 7S, for example. That both openings 7S, 7G are the same shape further helps provide uniformity and, thus, facility of manufacturing as well as providing a facile means of programming ground location. Uniformity of the openings 7S', 7G' at the forward end 140 of the housing 103 provides similar advantages. Moreover, such similarities facilitate interchanging of parts, use of signal contacts in more than one opening, and use of ground contacts in more than one opening.

The insulator 105 may be made by plastic injection molding techniques. The material of which the insulator is made should be electrically nonconductive material, for example polypropylene. The tubular portion 112 is configured to fit relatively closely with respect to the wall portion 61' of the signal opening 7S' of the housing 103. The opening 116 at the back end of the tubular portion 112 preferably has a slope or taper 150 leading to the hollow interior space 118 to facilitate guiding the contact arms 37 into the space.

Figure 20:
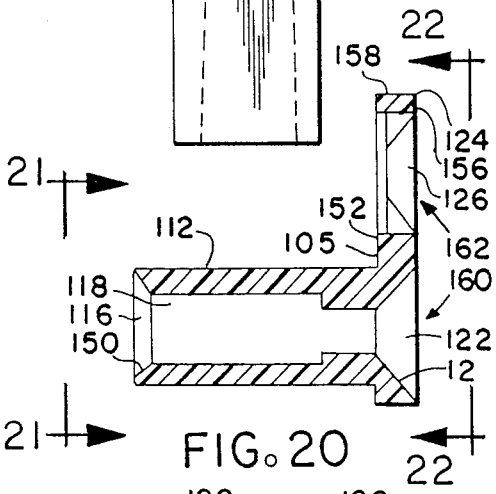
FIG. 20 is a side elevation view, partly in section, of the insulator for the one by one system of FIG. 10.
Figure 21:
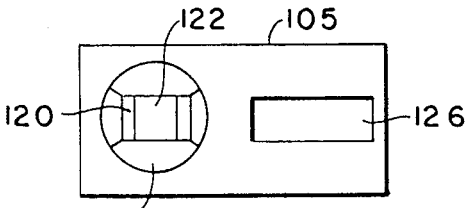
FIGS. 21 and 22 are, respectively, back end (top) and front end (bottom) views of the insulator of FIG. 20.
Figure 22:
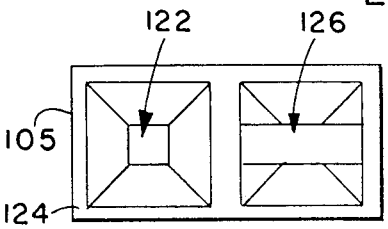
Figure 25:
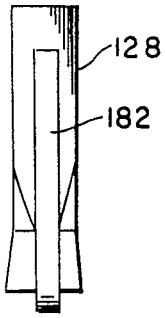
FIG. 25 is an opposite side elevation view of the contact of FIG. 23 looking generally in the direction of the arrows 25—25.
Figure 23:
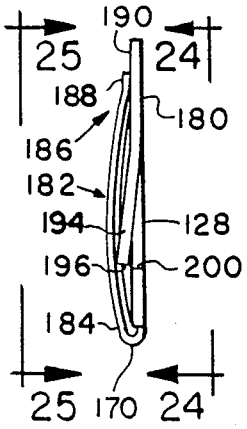
FIG. 23 is an end elevation view of a ground contact used in the one by one system of FIG. 10 and in other embodiments disclosed in the instant application.
Figure 24:
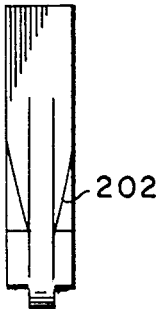
FIG. 24 is a side elevation view of the contact of FIG. 23 looking generally in the direction of the arrows 24—24.
Figure 26:
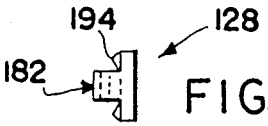
FIG. 26 is a front (bottom) end view of the contact of FIG. 23.

The insulator 105 is installed with the tubular portion 112 inserted into a signal opening 7S' in the housing 103. The back face 152 of the insulator 105 preferably abuts the front wall surface 154 of the housing 103, and the front wall surface 156 of the insulator 105 is exposed. Moreover, in the front portion 158 of the insulator 105 adjacent the tubular portion 112 is the slot opening 126 for access to the ground contact 128. Thus, as is seen in FIGS. 20–22, for example, the insulator 105 has a signal contact insulating portion 160 and a ground contact protection/aligning portion 162, both portions 160, 162 being formed as part of an integral assembly.

The thickness of the front portion 158 of the insulator 105 is about the same as the extent that the leading hairpin portions 170 of the ground contacts 128 extend from a ground opening 7G' beyond the front wall surface 154 of the housing 103, as is seen in FIGS. 11 and 13, for example. Such forward-most exposure of the ground contact portions 170 helps to assure that the ground contacts contact the ground pin near the end of housing 103 to minimize the path of the ground signal. Alternatively, if desired, the ground contact(s) may be recessed into the housing 103 and insulator 105 such that the leading hairpin portions 170 of the ground contact(s) is, for example, about 0.010 inch withdrawn within the insulator behind the front wall 156 thereof. The slot opening 126 may be sloped in the manner illustrated in the drawings to help guide a pin contact, such as one of the contacts 83 of FIG. 9, properly to engagement with the ground contacts 128 in the ground opening 7G of the housing 103.

It is noted here that in the just described preferred embodiment of the system 100, the insulator 105 includes the signal and ground portions 160, 162 as an integral structure. If desired, such portions need not be an integral structure in which case, for example, the portion 162 could be eliminated and the signal portion 160 of the insulator 105 could be used independently simply to provide the insulation and support functions for a terminator 102 and the signal contact 20 thereby.

Desirably, though, with both portions 160, 162 being integral, the front wall 156 of the insulator, indeed the entire front portion 158 thereof, provides an electrical insulating function for the front wall surface 154 of the housing 103 to prevent inadvertent short circuiting and the like with respect to a printed circuit board or other device to which the system 100 may be connected.

In each ground opening 7G' is inserted a pair of ground contacts 128, which are shown in detail in FIGS. 23–26. Each ground contact 128 has a main support body 180 of relatively thick stock material and a relatively thinner contacting portion 182. The above mentioned hairpin portion 170 of the ground contact 128 mechanically joins the main support body 180 and the contacting portion 182 providing a support for the forward end 184 of the contacting portion. The back end 186 of the contacting portion 182 preferably includes a flat surface area 188 intended to abut against and generally smoothly ride along the surface 190 of the main support body 180. Therefore, the contacting portion 182 appears as a dual supported bow contact of, for example, 0.006 inch thick stock (i.e. it is relatively thin and fragile). The contacts may be formed of beryllium copper and may in fact be goldplated. Such contact has relatively good compliance, stiffness, strength, and normal force characteristics, which are attendant a dual supported bow contact. The width of the contacting portion 182 is such that the contacting portion fits within the space between the apices 192 at the front end of the ground opening 7G' in the housing 103 (see FIG. 19). Therefore, movement of the contacting portion 182 as it is deformed in response to insertion or withdrawal of a pin contact or other external member with respect thereto generally is unimpeded by the walls defining the opening 7G'. The length that the hairpin portion 170 of the ground contact 128 extends forward (to the bottom as viewed in FIG. 23) relative to the main support body 180 is determined such that curvature at the hairpin curve 170 is generally smoothly curved (not sharply bent) and so that the extent that such hairpin portion 170 protrudes into and/or beyond the front portion 158 of the insulator 105 is pre-established.

The main support body 180 of the ground contact may be of relatively thicker stock, say 0.011 inch stock, than is the contacting portion 182 so that the main support body 180 will be relatively strong. Wedges or ears 194 are cut from the main support body 180 and are bent out of the major planar extent thereof, as is seen most clearly in FIG. 23. Such ears 194 have a sharp edge 196 intended to bite into the walls 198 of the signal opening 7G' of the housing 103 (FIG. 19) in order to lock the ground contact 128 in place in the manner illustrated in FIGS. 11–15, for example. The ears 194 actually are cut at area 200 and are bent along the line 202 (FIG. 24) to maximize the sharp exposure of the edges 196 to provide the desired biting and locking functions. The base of the ground contact is tapered out in order to make the primary connection of the ground contact with the housing at this point.

Figure 19:
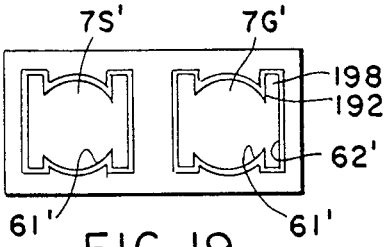

If desired, the ground contacts 128, as seen in FIG. 11, may include a bump 210 that is formed by pressing on the back surface 212 of the main support body 180 using an appropriate tool. Such bump 210 may be located directly behind the approximate contacting point of the bow contacting portion 182 to limit the maximum deflection of the bow contacting portion 182 as a pin contact or the like is inserted into the opening 7G' (FIG. 19).

The one by one coaxial cable termination system 100 may be manufactured and assembled as follows. The terminator 102 may be made in the manner described above with reference to the terminator 2 except that the sheath 22 is not employed during molding of the strain relief 24. The housing 103 is made by die casting. The ground contacts 128 may be formed using appropriate metal forming and shaping techniques. A pair of ground contacts 128 are inserted into the ground opening 7G' to the relative positions illustrated in FIGS. 11–15, for example. The terminator 102 is inserted into the opening FIG. 19 at the back end of the housing 103 to the position illustrated in FIGS. 11, for example. The insulator 105 is installed to the position illustrated in FIGS. 11. The order of assembly of the several parts just described need not be precisely followed; for example, the insulator may be installed before the terminator is installed in the housing 103. However, due to the space limitation of the slot 126 in the insulator provided for access to the ground contacts 128, it usually is necessary to install the ground contacts before installing the insulator.

The thusly manufactured one by one coaxial cable termination system 100 then may be used to effect connection of the signal conductor 30 of the coaxial cable 110 to a pin contact while maintaining good shielding and like functions. The tight fit and secure electrical engagement of the ground contacts 128 with the housing 103 as well as the locating of the ground contacts very close to the front end of the system 100 (both in terms of the point of electrical connection of the ground contacts to the housing and the leading end of the hairpin portion 170 of the ground contacts) helps to assure there will be minimum cross talk, helps to carry ground currents in a straight path to avoid interference, avoids charge accumulation, and so on. The use of dual supported bow type contacting portions for both the signal and ground contacts 20, 128 provides the above mentioned strength, normal forces, compliance, resiliency, etc. that might be characteristic of a heavier duty contact but in the past was not available for rather small light guage contacts. Using such very small contacts further facilitates miniaturizing the overall system 100 and closely spacing the various contacts thereof.

High Density Coaxial Cable Termination System

Figure 28:
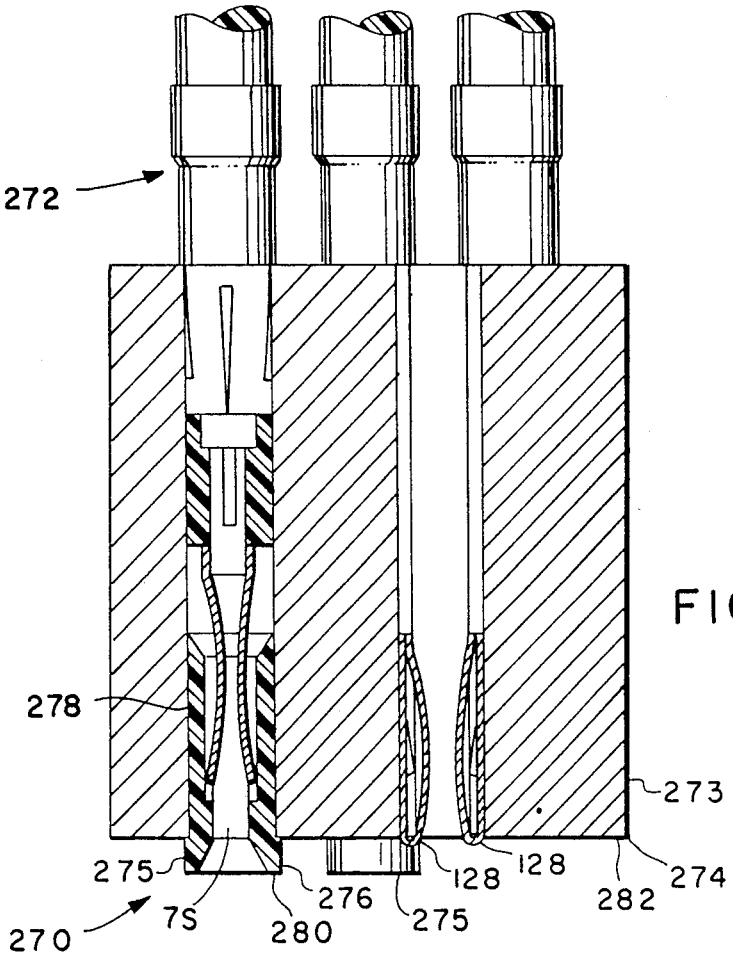
FIG. 28 is a side elevation section view of the system of FIG. 27 looking generally in the direction of the arrows 28—28.
Figure 27:
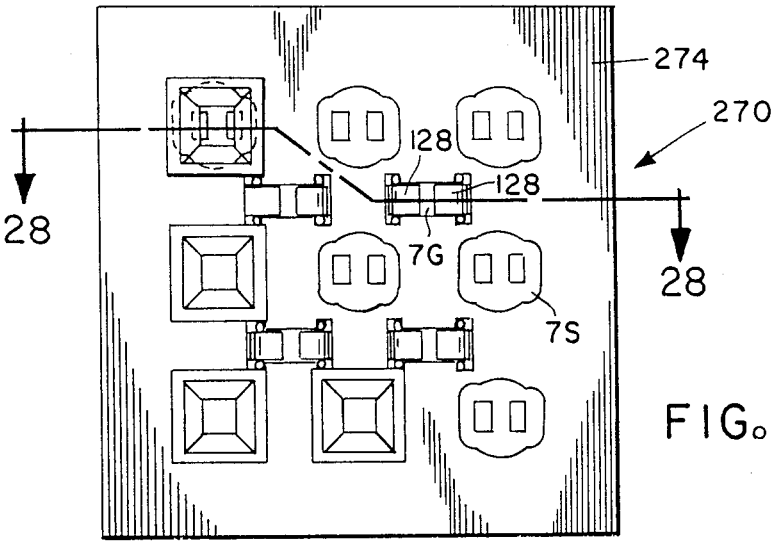
FIG. 27 is a front end view of a coaxial cable termination system with space for nine signal contacts and four ground contact connections, four of the signal contact locations being covered by discrete insulators and five being uncovered.

Turning now to FIGS. 27 and 28, an alternate nine by four coaxial cable termination system is shown at 270. The high density system 270 includes the capability of containing multiples of nine coaxial cables, each including a signal conductor and configured, for example, in the form of the terminators 272, which are similar to the terminators 102 described above, positioned in a conductive housing 273. Thus, are nine signal openings 7S in the front 274 of the housing 273 for insertion into such signal openings of respective pin contacts, such as those designated 83 in FIG. 9, to engage respective signal contacts 20 in the respective openings. The high density system 270 also includes a plurality of ground contacts 128 in respective modified ground openings 7G''. The openings 7G'' cooperate with the ground contacts to hold the ground contacts in place in the manner described above with respect to FIGS. 11–14.

A discrete insulator 275 has an outer portion 276 that protrudes outside the signal opening 7S and also has a hollow tubular portion 278 similar to the hollow tubular portion 112 described above with reference to the insulator 105 (FIG. 11). The discrete insulator 275 generally is of the same shape and has the same functions as the signal portion 160 of the insulator 105 (FIG. 20). However, a separate discrete insulator 275 is required for each of the signal openings 7S and terminator 272 therein. The front end wall 280 of the insulator 275 provides a stand-off function so that when the nine by four system 270 is installed on a printed circuit board, on a pin field through a shroud 80 (FIGS. 7–9), etc., the front wall surface 282 of the housing 273 will be electrically insulated from that beyond the front wall 280 of the insulators 275. In the discrete insulator version of the system 270 illustrated in FIGS. 27 and 28, the ground contacts 128 are not separately insulated by a portion, such as portion 162, of an insulator, e.g. as is shown contrarily in FIG. 20.

A particular advantage to the high density system 270 illustrated in FIGS. 27 and 28 is the ability simultaneously to effect connections of plural signals and grounds in the housing 273 by plugging the entire system 270 onto a pin field, for example. Importantly, the locating of a ground between four signals in the pattern illustrated in FIG. 27, for example, tends to maximize the efficient positioning of the contacts while also optimizing control of cross talk.

The embodiment illustrated in FIGS. 27 and 28 depicts several alternate possibilities with respect to the shape of the signal openings 7S, in particular such shape being different at the front end 282 of the housing 274 relative to the shape of the ground openings 7G. To simplify the drawing of FIG. 27 and to facilitate showing several of the parts of the system 270, only four insulators are shown, whereas five of the signal openings 7S do not have insulators shown installed.

Figure 30:
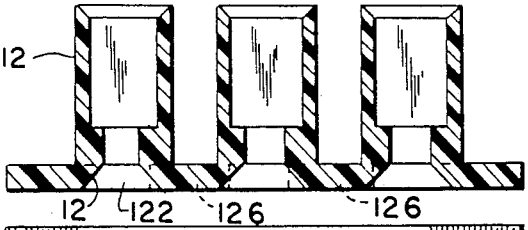
FIG. 30 is a side elevation section view of the insulator of FIG. 29 looking generally in the direction of the arrows 30—30.
Figure 29:
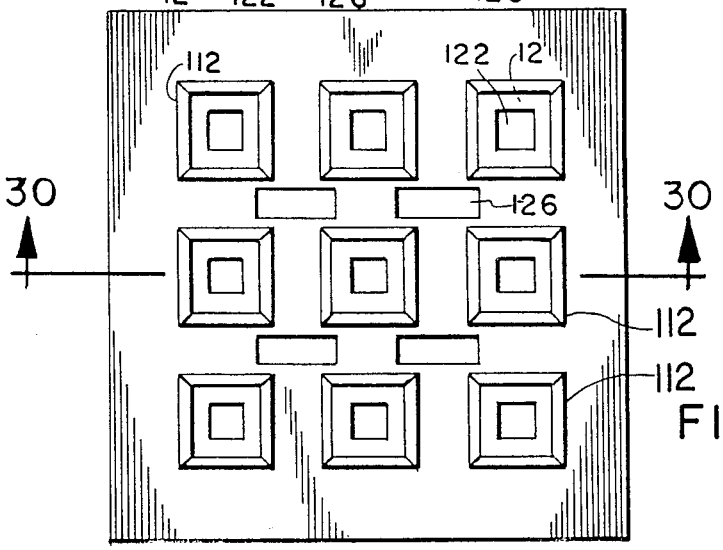
FIG. 29 is a front plan view of a modified group insulator for use in the system of FIG. 27, for example.

Briefly referring to FIGS. 29 and 30, a discrete insulator 290 that may be used in the nine by four coaxial cable termination system 270 is illustrated. The insulator 290 is rather similar to the insulator 105 described in detail above, for example with reference to FIGS. 20–22; however, the layout of the tubular portions 112 thereof is designed to fit the nine signal opening 7S pattern of the housing 274 in FIG. 27 and the slot openings 126 for the ground contacts are located between four signal insulating portions 160 also to correspond to the pattern of ground contact arrangement in the system 270 of FIG. 27. Also advantageously the entire front wall of the insulator 290 is an integral piece of maximize insulating protection for the front end wall of the housing. The insulator 290 may be made by plastic injection molding a single part that may be installed in the housing 274 effecting placement of the insulating tubular portions 112 in respective signal openings 7S simultaneously.

The foregoing provides description of several preferred embodiments. It will be appreciated that features of the invention, though, may be included in other and in equivalent devices. For example, the one by one and nine by four patterns only are examples and other patterns for the signals and grounds may be used.

INDUSTRIAL APPLICATION

In view of the foregoing it will be appreciated that the present invention provides for electrical interconnections, especially of coaxial cables, and more especially of miniature coaxial cables.

The embodiments of the invention in which an exclusive property or privilege is claimed are, as follows:

1. A coaxial cable termination system, comprising a coaxial cable terminator including a coaxial cable having signal and shield conductors and insulation separating said conductors, an electrical contact electrically connected to said signal conductor, said electrical contact having contacting means for electrically connecting with an external member inserted to engagement with respect thereto, and a strain relief for holding together said coaxial cable and electrical contact; electrically conductive housing means having a first opening for receiving therein from one end said terminator to hold the same in position to make electrical connection with an external member inserted into said housing means to engage said electrical contact; and insulator means having a tube-like portion insertable into said first opening in said housing means from the opposite end for covering at least a part of said contacting means of said electrical contact to insulate said contacting means from said housing means within said first opening, said housing means having a second opening, and said insulator means including a front wall portion integral with said tube-like portion, said front wall portion overlying a surface of said housing means at said opposite end and including first and second opening means for providing access from said opposite end to said first and second openings, respectively.

2. The system of claim 1, said tube-like portion of said insulator means being open at said opposite end to receive insertion therein of an external member for engagement with said contacting means.

3. The system of claim 1, said insulator means comprising guide means for guiding an external member to proper alignment with respect to said contacting means.

4. The system in claim 1, said signal conductor being soldered or welded to said electrical contact.

5. The system of claim 1, said insulator means and the relative positions of said electrical contact and housing means being related substantially to match the characteristic impedance of said terminator to said coaxial cable.

6. The system of claim 1, said housing means being an unitary die cast body of electrically conductive material.

7. The system of claim 1, said first opening being of relatively large cross section throughout the major extent thereof in said housing means for effectively narrowing the entrance to said first opening for such external member.

8. The system of claim 7, said contacting means comprising plural bowed contacting portions that are resiliently deformable, said contacting portions being supported at opposite end portions thereof, the leading end portions being supported by said insulator means.

9. The system of claim 1, comprising shield terminator means for electrically coupling said shield conductor to said housing means.

10. The system of claim 9, said shield terminator means comprising a hollow tubular member for electrically engaging said shield conductor and a wall of said housing means within said first opening.

11. The system of claim 10, said hollow tubular member having a stepped wall configuration for engaging both an end face of said housing means proximate said first opening thereof and a wall of said housing means within said first opening.

12. The system of claim 11, said strain relief being molded to at least part of said shield terminator means and electrical contact.

13. The system of claim 11, said shield terminator means being soldered or welded to said shield conductor.

14. The system of claim 1, further comprising ground means in said housing means to connect electrically said housing means to an external member.

15. The system of claim 14, said ground means being positioned in said second opening.

16. The system of claim 15, said ground means comprising a ground contact press fit into said second opening and exposed at an end of said second opening to permit insertion of a pin contact with respect thereto.

17. The system of claim 15, said ground means comprising a ground contact, said ground contact having a bow contact means for contacting a member inserted with respect thereto and support means for supporting said bow contact means.

18. A coaxial cable termination system comprising a coaxial cable terminator including a coaxial cable having signal and shield conductors and insulation separating said conductors, an electrical contact electrically connected to said signal conductor, said electrical contact having contacting means for electrically connecting with an external member inserted to engagement therewith, and a strain relief for holding said coaxial cable and electrical contact together; housing means having a terminator opening for receiving therein said terminator to hold the same in position to make electrical connection with an external member inserted into said housing means to engage said electrical contact, said housing means being electrically conductive and having a ground opening therein, ground means positioned in said ground opening for electrically connecting said housing means to an external member, said ground means including a ground contact, said ground contact having bow contact means for contacting a member inserted to engagement therewith, support means for supporting said bow contact means, and sharp edge means for biting into a wall of said ground opening to secure said ground contact in said ground opening; and insulator means insertable into said terminator opening in said housing means for covering at least part of said contacting means of said electrical contact to insulate said contacting means from said housing means within said terminator opening.

19. The system of claim 18, said ground opening including two ground contacts with respective bow contact means facing each other to define a contacting area therebetween.

20. A coaxial cable termination system comprising a plurality of coaxial cable terminators each including a coaxial cable having signal and shield conductors and insulation separating said conductors, an electrical contact electrically connected to said signal conductor, said electrical contact having a contacting portion for electrically connecting with an external member inserted to engagement therewith, and a strain relief body molded directly to at least part of said coaxial cable and electrical contact for holding the same in relatively fixed positions with respect to each other; housing means having a plurality of terminator openings for receiving therein from one end respective ones of said terminators to hold the same in position to make electrical connection with respective external members inserted into said housing means to engage the electrical contacts of said terminators, said housing means being electrically conductive and having a ground opening therein; ground means positioned in said ground opening for electrically connecting said housing means to an external member; and protective insulator means for covering at least part of said contacting portion, said insulator means including a plurality of tube-like portions insertable into said terminator openings in said housing means from the opposite end.

21. The system of claim 20, said insulator means comprising plural discrete insulators.

22. The system of claim 20, said insulator means comprising plural tube-like portions, each integrally coupled to a common front wall of said insulator means.

23. A coaxial cable termination system, comprising a coaxial cable terminator including a coaxial cable having signal and shield conductors and insulation separating said conductors, an electrical contact electrically connected to said signal conductor, said electrical contact having contacting means for electrically connecting with an external member inserted to engagement with respect thereto, and a strain relief for holding together said coaxial cable and electrical contact; electrically conductive housing means having a terminator opening for receiving therein from one end said terminator to hold the same in position to make electrical connection with an external member inserted into said housing means to engage said electrical contact; and insulator means having a tube-like portion insertable into said opening in said housing means from the opposite end for covering at least a part of said contacting means of said electrical contact to insulate said contacting means from said housing means within said opening; said housing means having a front wall surface at said opposite end of said opening, said insulator means including a front wall portion with said tube-like portion, said front wall portion overlying said front wall surface of said housing means at said opposite end of said opening and including opening means for providing access to said opening.

24. The system of claim 23, comprising shield terminator means for electrically coupling said shield conductor to said housing means.

25. The system of claim 24, said shield terminator means comprising a hollow tubular member for electrically engaging said shield conductor and a wall of said housing means within said opening.

26. The system of claim 25, said hollow tubular member having a stepped wall configuration for engaging both an end face of said housing means proximate said opening thereof and a wall of said housing means within said opening.

27. The system of claim 25, said strain relief being molded to at least part of said shield terminator means and electrical contact.

28. The system of claim 25, said housing means having a locking detent in said opening, and said terminator having a stepped portion for cooperating with said locking detent to secure the terminator in said opening.

29. The system of claim 25, said shield terminator means being soldered or welded to said shield conductor.

30. The system of claim 23, said insulator means and the relative positions of said electrical contact and said housing means being related substantially to match the characteristic impedance of said coaxial cable.

31. The system of claim 23, said housing means being formed as one part, said opening having one cross-sectional shape at one end and a different cross-sectional shape at the opposite end.

32. The system of claim 23, said opening being of relatively large cross section throughout the major extent thereof in said housing means, and said insulator means including guide means for effectively narrowing the entrance to said opening for such external member.

33. The system of claim 23, said insulator means comprising guide means for guiding an external member to proper alignment with respect to said contacting means;

34. The system of claim 33, said contacting means comprising plural bowed contacting portions that are resiliently deformable, said contacting portions being supported at opposite end portions thereof, the leading end portions being supported by said insulator means.

35. The system of claim 23, said housing means being a unitary die cast body of electrically conductive material.

36. The system of claim 23, said housing means having plural openings therethrough for receiving therein respective terminators.

37. The system of claim 36, further comprising shroud means for shielding a plurality of electrical contacts arranged on a pin field, said terminators and housing means being capable of being plugged onto such electrical contacts in said pin field within said shroud means.

38. The system of claim 23, further comprising ground means in said housing means to connect electrically said housing means to an external member.

39. The system of claim 38, said housing means having a ground opening, and said ground means comprising a ground contact press fit into said ground opening and exposed at an end of said ground opening to permit insertion of a pin contact with respect thereto.

40. The system of claim 39, said ground means comprising a ground contact, said ground contact having a bow contact means for contacting a member inserted with respect thereto and support means for supporting said bow contact means.

41. The system of claim 38, said housing means having plural terminator openings for receiving therein respective said terminators and for permitting external members to be inserted to electrical engagement with respect to respective terminators, said ground means including a ground contact positioned in said housing means and surrounded by a plurality of said terminators.

42. The system of claim 41, wherein a plurality of terminators are circumferentially equally spaced about said ground contact.

43. The system of claim 42, wherein said ground means including a plurality of ground contacts each surrounded by plural terminators.

44. The system of claim 43, wherein said housing means has received therein nine terminators and four ground contacts each surrounded by a different grouping of four of said nine terminators.

45. The system of claim 23, said opening having an oval multicurved configuration substantially to maintain relative spacing of said contacting means and housing means to provide impedance matching relative to said coaxial cable.

46. The system of claim 23, said cable being approximately 50 ohm coax, said electrical contact being operative to mate electrically with 0.025 inch pin contacts.

47. The system of claim 23, further comprising electrically conductive plating material in at least part of said opening to enhance the electrical connection between said terminator and said housing means.

48. The system of claim 23, said housing means having plural openings therethrough for receiving therein respective terminators, and said insulator means including plural tube-like portions inserted into respective ones of said plural openings and integrally coupled to a common front wall of said insulator means.

* * * * *

UNITED STATES PATENT AND TRADEMARK OFFICE

CERTIFICATE OF CORRECTION

PATENT NO. : 4,964,814

DATED : October 23, 1990

INVENTOR(S) : John N. Tengler, Alan L. Roath, John T. Venaleck

It is certified that error appears in the above-identified patent and that said Letters Patent is hereby corrected as shown below:

Column 4, Line 48, "for respective" should read --of respective--.

Column 5, Line 6, "inclose" should read --in close--.

Column 8, Line 22-23, delete "portion 67 thereof that engages the cable shield conductor 31 and remains."

Column 12, Line 68, "thereby" should read --thereof--.

Column 13, Line 67, "7G" should read --7S--.

Column 15, Line 45, after "Also" insert --,--.

Column 15, Line 46, "piece of" should read --piece to--.

Column 16, line 45, after "means" insert--, and said insulator means including guide means--.

UNITED STATES PATENT AND TRADEMARK OFFICE

CERTIFICATE OF CORRECTION

PATENT NO. : 4,964,814

DATED : October 23, 1990

INVENTOR(S) : John N. Tengler, Alan L. Roath, John T. Venaleck

It is certified that error appears in the above-indentified patent and that said Letters Patent is hereby corrected as shown below:

Column 20, line 14, "including" should read --includes--.

Signed and Sealed this

Thirty-first Day of August, 1993

*Attest:*

*Attesting Officer*

BRUCE LEHMAN

*Commissioner of Patents and Trademarks*